United States Patent [19]

Fryfogle

[11] Patent Number: 4,848,126

[45] Date of Patent: Jul. 18, 1989

[54] DRYWALL BEAD SPREADER

[76] Inventor: David Fryfogle, 2606 SE Carroll St., Stuart, Fla. 34997

[21] Appl. No.: 238,205

[22] Filed: Aug. 30, 1988

[51] Int. Cl.[4] ..... B21D 5/00; B21D 5/08

[52] U.S. Cl. ..... 72/176; 72/75; 72/379; 493/409; 493/443; 493/454; 493/395; 493/968

[58] Field of Search ..... 72/176, 379, 274, 75, 72/127; 493/409, 410, 436, 443, 447, 448, 454, 455, 395, 968

[56] References Cited

U.S. PATENT DOCUMENTS

| | | | |
|---|---|---|---|
| 245678 | 8/1881 | Weaver . | |
| 270,077 | 1/1883 | Jones . | |
| 420,576 | 2/1890 | Heesom . | |
| 573,955 | 12/1896 | Atkins | 72/176 |
| 2,802,509 | 8/1957 | Anderson et al. . | |
| 3,348,401 | 8/1964 | Sporck . | |
| 3,718,176 | 2/1973 | Jacob . | |
| 3,964,286 | 6/1976 | Oerther . | |
| 4,579,552 | 4/1986 | Brannlund | 493/439 |

FOREIGN PATENT DOCUMENTS

| | | | |
|---|---|---|---|
| 218454 | 12/1961 | Austria | 72/176 |
| 22448 | 6/1972 | Japan | 72/176 |
| 204570 | 8/1939 | Switzerland | 72/176 |

*Primary Examiner*—Daniel C. Crans

[57] ABSTRACT

The invention relates to a drywall corner bead spreader device. The device comprises a stationary support portion and a movable pressure applying portion. When a length of drywall corner bead is placed on the stationary support portion with its flanges facing upwardly adjustment of the movable pressure applying portion into contact with the flanges will force the flanges to assume an included angle greater than its normal ninety degree orientation. The movable pressure applying portion includes a freely rotating spreader ball which will rotate as the corner bead is pulled from beneath the spreader ball resulting in reduced friction and providing a uniform included angle to the flanges in excess of ninety degrees.

16 Claims, 1 Drawing Sheet

DRYWALL BEAD SPREADER

BACKGROUND OF THE INVENTION

In today's construction industry most homes are built with the interior walls constructed of wallboard. The days of plastered walls have been superceded by the use of wallboard. The main reason for this change is due to the high costs related to the labor intensive art of plastering a wall. Initially, a wire mesh must be installed and then the plastering which was a multistep process with days of drying between the several steps. Thus, it can readily be seen that the use of wallboard not only reduces the costs of the added labor but also significantly reduces the amount of time required to complete a particular job.

Wallboard is available in four feet by eight feet and also four feet by twelve feet sheets, with the latter size being the most frequently used size. After the wallboard has been applied to the interior wall studs, the joints between adjacent sheets of wallboard must be taped and spackled as well as the nail heads. Some installers use a bead of adhesive on the wall studs to reduce the number of nails which must be spackled. All inside corners are taped and spackled while the outside corners receive a metallic corner bead which is nailed to the opposite faces of the wall forming the outside corner. The corner bead is a length of pre-made metallic beading which is commercially available in eight feet lengths. Integral with the corner bead are a pair of flange portions that form a ninety degree angle therebetween. Each of the flanges extending from the bead is provided with a plurality of pre-punched apertures along the entire length. The purpose of these apertures is to permit spackling to flow therein once the corner bead is attached to an outside corner by a plurality of spaced nails.

As indicated earlier, a length of corner bead is manufactured with the apertures punched therein and having an included angle of ninety degrees between the two outwardly extending flanges. The pre-set angle of ninety degrees is fine for a ninety degree outside corner. However, with modern architecture's propensity for corner walls which have an angle greater than ninety degrees, the conventional ninety degree drywall corner bead can no longer be used in its manufactured form. As a result of this need for a drywall corner bead to have an included angle greater than ninety degrees, drywall installers have resorted to various means of increasing the included angle between the corner bead flanges. For example, it is common practice for a drywall installer to place a length of drywall corner bead on a cement floor with the flanges facing upwardly and then, by use of a hammer with repeated blows, strike the hammer between the flanges to increase the angle therebetween. As can readily be seen this is a time consuming process which almost always results in the corner bead being dimpled along its length due to the repeated hammer blows in the flange spreading process. Since every blow of the hammer is not of the same exact intensity and force, the dimples are not uniform and result in spackling problems later when the corner bead is spackled by the drywall finisher.

SUMMARY OF THE INVENTION

It was with the above noted problems in mind that applicant was motivated to develop the subject drywall corner bead spreader device. With applicant's device, the included angle between flanges may be increased from ninety degrees to approximately one-hundred eighty degrees. The instant device permits the user to vary the angle within the above noted range and once set for the desired angle merely pulling on the end of the corner bead allows the length of corner bead to freely pass between a rolling steel ball and its backing member to uniformly spread the flanges. The procedure is simple and quick without any undesired dents or dimples in the corner bead flanges.

OBJECTS OF THE INVENTION

An object of the invention is to provide a device for increasing the included angle between drywall corner bead flanges.

Another object of the invention is to provide a device which is inexpensive and can be used by a single drywall installer.

A further object of the invention is to provide a device which saves time as compared to known prior art methods.

A still further object of the invention is to provide a device which will uniformly spread the corner bead flanges without any resulting dents or dimples.

Yet another object of the invention is to provide a device which is portable and may be taken down from its support and moved from job site to job site.

A still further object of the invention is to provide a corner bead flange spreader which can adjustably increase the included angle from ninety degrees to any desired angle up to approximately one hundred eighty degrees.

These and other objects of the instant invention will become more apparent hereinafter. The instant invention will now be described with particular reference to the accompanying drawings which form a part of this specification wherein like reference characters designate the corresponding parts in the several views.

DETAILED DESCRIPTION OF THE DRAWINGS

Figure 1:
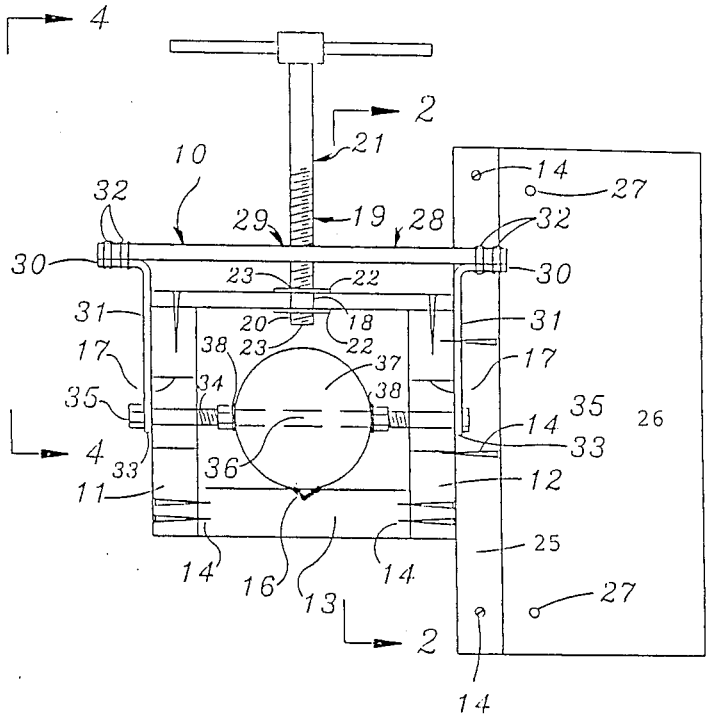
FIG. 1 is a front elevational view of the spreader device and its support structure.

Referring now to FIG. 1, there is shown a front elevation view of the corner bead spreader device generally indicated by the reference numeral 10. Bead spreader 10 comprises a plurality of stationary components and also a plurality of movable components. First, we will discuss the stationary components of device 10 which includes a pair of horizontally extending members 11 and 12. As viewed in FIG. 1, left horizontal member 11 is interconnected with right horizontal member 12 by a lower horizontal member 13 and secured thereto by a plurality of screws 14. Members 11, 12 and 13 are all made of wood. Additionally, there is an upper horizontal member 15 which is made of steel and attached to the upper vertical ends of left and right horizontal members, 11 and 12, respectively by screws 14.

Lower horizontal member 13 is provided with a V-groove at 16 for receiving the bead of the corner bead as will be described later with respect to FIGS. 3 and 5. Left and right horizontal members 11 and 12 are each provided with an elongated vertically extending channel 17. Upper horizontal member 15 is provided with a centrally located aperture 18 which receives the lowermost end 20 of adjusting screw 21. The lowermost end 20 is unthreaded and anchored to upper horizontal member 15 by an upper and lower washer 22 with a pair of cotter pins 23 outboard thereof and extending through the lowermost end 20 of adjusting screw 21.

The above description covers all the stationary components except for two additional support members. First vertically extending member 25 which is secured to left horizontal member 11 by a pair of screws 14. Attached to the rear face of vertically extending member 25 and positioned at a right angle thereto is a second vertically extending member 26 which is provided with a pair of pre-drilled holes 27 for ready attachment to an interior door jamb or any other supporting surface.

Having described all the stationary components of spreader device 10, we will now describe the moving components thereof. Positioned above upper horizontal member 15 is movable horizontal member 28 which is provided with a centrally located threaded aperture 29 which receives threaded portion 19 of adjusting screw 21. Mounted immediately below opposite ends of movable horizontal member 28 are flanged portions 30 of vertically extending actuator arms 31 which are secured thereto by a plurality of bolts 32. At the lowermost end of each actuator arm 31 is an aperture 33 for receiving threaded axle 34 which is held in place by a nut 35 at each end thereof. The central portion 36 of axle 34 is unthreaded to permit spreader ball 37 to freely rotate thereon. On opposite sides of spreader ball 37 are a pair of washers 38 and nuts 39. The purpose of washers 38 and nuts 39 is to keep spreader ball 37 centrally located with respect to V-groove 16 in lower horizontal member 13 for applying uniform pressure to the corner bead in the spreading process.

The manner of using bead spreader device 10 will now be described in detail. Assuming spreader device 10 has been mounted on a sturdy support such as a door jamb or other support the device is now ready for use. Initially, adjusting screw 21 must be rotated sufficiently to raise movable horizontal member 28, actuator arms 31 and also spreader ball 37. As the adjusting screw 21 is rotated the threaded interconnection between threaded portion 19 and threaded aperture 29 raises movable horizontal member 28. Threaded axle 34 will be permitted to move vertically in channels 17. Having raised spreader ball 37 sufficiently, a length of corner bead 40 may be inserted below spreader ball 37 with the bead 41 resting in V-groove 16 and the flanges 42 of the corner bead facing upwardly as illustrated in FIG. 3. Depending upon the desired spread of the flanges 42, the adjusting screw 21 is rotated to lower spreader ball into the space between flanges 42. After the end of corner bead 40 has been positioned and spreader ball 37 has been lowered sufficiently to provide the desired spread of flanges 42, merely pulling on the end of corner bead 40 allows corner bead 42 to continuously feed under spreader ball 37 in a smooth fashion. As indicated earlier, pulling on corner bead 42 causes spreader ball 37 to freely rotate on axle 34 resulting in a uniform spread imparted to flanges 42 along the entire length of corner bead 40.

Figure 2:
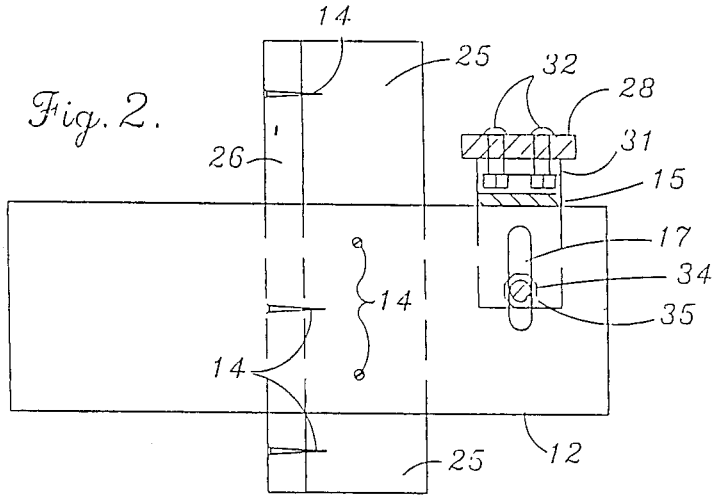
FIG. 2 is a sectional view taken along the section line 2—2 in FIG. 1.

Referring now to FIG. 2, which is a sectional view taken along the plane 2613 2 in FIG. 1, there is an illustration of the manner in which spreader device 10 is secured to supports 25 and 26. It is to be noted spreader device 10 is mounted on the forward end of support 12 and also left horizontal support member 11 which is not shown in this figure.

Figure 3:
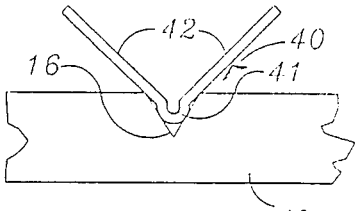
FIG. 3 is an illustration of the corner bead and its backing member.

FIG. 3 is an illustration of how corner bead 40 is placed in V-groove 16 with flanges 42 facing upwardly.

Figure 4:
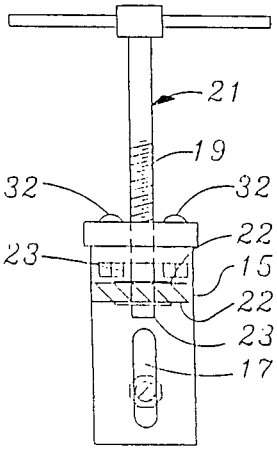
FIG. 4 is a sectional view taken along the section line 4—4 in FIG. 1.

FIG. 4 is a side view looking at the left side of spreader device 10 as indicated by lines 4—4 in FIG. 1. All the components illustrated therein are movable upon rotation of adjusting screw 21 except upper horizontal member 15, shown in dashed lines since it is behind actuator arm 31.

Figure 5:
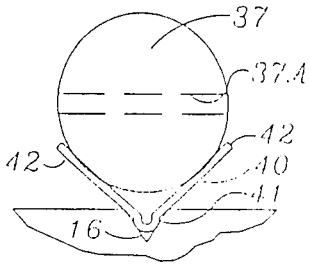
FIG. 5 is an illustration of the bead spreader in contact with a strip of corner bead.

FIG. 5 is a view somewhat similar to FIG. 3. However, in FIG. 5, spreader ball 37 is shown as being in contact with flanges 42.

Although the subject invention has been described in connection with the use as a drywall corner bead spreader device, it is conceivable that the device may have applications in addition to the one specifically set forth.

While the invention has been described in its preferred embodiment, it is to be understood that words which have been used are words of description rather than limitation and that changes may be made within the purview of the appended claims without departing from the full scope or spirit of the invention.

Having thus described my invention, I claim:

1. An apparatus for increasing the angle between two relatively disposed flange members of an article, said apparatus comprising support means having a first pair of horizontally disposed stationary members and a second pair of horizontally disposed stationary members perpendicularly attached to said first pair of horizontally disposed members; spreading means in the shape of a ball and having an axle adjustably received by said first pair of horizontally disposed stationary members; pressure applying means operably connected to said spreading means and one of said second pair of horizontally disposed stationary members whereby an article having a pair of oppositely disposed flange members can have the relative angle between said flange members increased by adjustment of said pressure applying means when placed between and engaged with spreading means and one of said second pair of horizontally disposed members while gripping and pulling the free end of said article results in the uniform spreading of said flange members to their desired angle along the entire length thereof.

2. An apparatus of the character described in claim 1 wherein said first pair of horizontally disposed stationary members is further provided with a pair of vertically oriented mounting members whereby said entire apparatus can be removably mounted to a supporting structure.

3. An apparatus of the character described in claim 1 wherein said spreading means comprises a steel ball with said axle received in a pair of elongated channels formed in the mid-portion of said first pair of horizontally disposed stationary members.

4. An apparatus of the character described in claim 3 wherein said steel ball is freely rotatable on said axle to reduce the amount of force required to pull said article through spreading means.

5. An apparatus of the character described in claim 1 wherein said pressure applying means includes adjusting screw means vertically supported by one of said second pair of horizontally disposed stationary members.

6. An apparatus of the character described in claim 5 wherein said one of said second pair of horizontally disposed stationary members includes a centrally located aperture and receives the lowermost non-threaded end of said adjusting screw means.

7. An apparatus of the character described in claim 5 wherein said adjusting screw means is further provided with a washer above and below said one of said second pair of horizontally disposed stationary members and a pair of cotter pins above and below said washers to provide vertical support and stability to said adjusting screw means.

8. An apparatus of the character described in claim 6 wherein said pressure applying means further includes a movable horizontal member threadably connected to said adjusting screw means.

9. An apparatus of the character described in claim 8 wherein said pressure applying means further includes a pair of actuator arms which are operably connected to opposite ends of said movable horizontal member.

10. An apparatus of the character described in claim 9 wherein said pair of actuator arms extend downwardly from said movable horizontal member and are each provided with a bore therein; said bores being in vertical alignment with said pair of elongated channels and receive the free ends of said axle.

11. An apparatus of the character described in claim 10 wherein said free ends of said axle are secured in place by a pair of nuts whereby appropriate rotation of said adjusting screw forces said horizontal movable member, said actuator arms, said axle and said spreader means down into contact with said flange members of an article to uniformly spread said flanges to their desired angle when pulled from between said spreading means and the other of said pair of horizontally disposed stationary members.

12. An apparatus for increasing the angle between two relatively disposed flange members of an article, said apparatus comprising: a pair of horizontally spaced support members, an upper horizontal member perpendicularly disposed relative to said pair of horizontally spaced support members securely attached thereto at the distal ends thereof; a lower horizontal member parallel to said upper horizontal member securely fastened at opposite ends to a lower portion of each of said pair of horizontally spaced support members; channel means formed in the mid-portion of each of said pair of horizontally spaced support members, first aperture means centrally located in said upper horizontal member; a movable horizontal member disposed above said upper horizontal member; said movable horizontal member provided with a threaded aperture in vertical alignment with said aperture means in said upper horizontal member; actuator arm means securely attached to opposite ends of said movable horizontal member at the upper end thereof and extending downwardly along outer-faces of said pair of horizontally spaced support members; second aperture means in the lowermost ends of said pair of actuator arms; axle means extending horizontally with opposite ends of said axle means projecting through said channel means of said pair of horizontal support members and said second aperture means of said pair of actuator arms; spreading means centrally positioned on said axle means, adjustment means received in said aperture means of said upper horizontal member and said threaded aperture of said movable horizontal member whereby placement of an article having two relatively disposed flange members between and in engagement with said spreading means and said lower horizontal member can have the angle between said flange members increased depending upon the adjustment position of said adjustment means.

13. An apparatus of the character described in claim 12 wherein said channel means comprises a centrally located vertically extending slot in each of said pair of horizontal spaced support members.

14. An apparatus of the character described in claim 12 wherein said first aperture means in said upper horizontal member comprises a centrally located bore therein for receiving the lowermost end of said adjustment means.

15. An apparatus of the character described in claim 12 wherein said actuator arm means comprises a pair of inverted L-shaped members, each having a short leg and a longer leg with each of said short legs fixedly attached to the outer ends of said movable horizontal member; said longer legs having second aperture means for receiving said opposite ends of said axle means.

16. An apparatus of the character described in claim 12 wherein said spreading means comprises a smooth steel ball for applying spreading pressure to said opposite flanges of an article when placed thereunder and pulled therefrom.

* * * * *